United States Patent [19]

Spano

[11] 3,938,317

[45] Feb. 17, 1976

[54] SERIAL TIME READ OUT APPARATUS

[76] Inventor: John D. Spano, 8220 E. Garfield Apt. M-23, Scottsdale, Ariz. 85257

[22] Filed: Aug. 10, 1974

[21] Appl. No.: 498,553

[52] U.S. Cl. ..... 58/23 R; 58/126 C
[51] Int. Cl.[2] ..... G04C 3/00; G04B 19/06
[58] Field of Search ..... 58/23 R, 24 R, 50 R, 126 C

[56] References Cited

UNITED STATES PATENTS

| | | | |
|---|---|---|---|
| 3,194,003 | 7/1965 | Polin | 58/23 R X |
| 3,681,914 | 8/1972 | Lowengart | 58/24 R |
| 3,788,058 | 1/1974 | Idei et al. | 58/23 R |

*Primary Examiner*—Edith Simmons Jackmon
*Attorney, Agent, or Firm*—H. Gordon Shields

[57] ABSTRACT

Time keeping apparatus is disclosed in which time is decoded either orally or tactilely by visually handicapped persons.

10 Claims, 13 Drawing Figures

SERIAL TIME READ OUT APPARATUS

BACKGROUND OF THE INVENTION

1. Field of the Invention:

This invention relates to time keeping apparatus, and, more particularly, to watches or clocks in which time is serially decoded or read out by an individual in response to a specific request or command by the individual.

2. Description of the Prior Art:

Persons with visual handicaps are limited in their ability to tell time, or in their ability to perceive time from a watch, clock, or the like. Typically, a visually handicapped person will use a watch or a clock with braille numerals on the face. By referring to the position of the hands with respect to the braille numerals, the individual is able to ascertain the current time. However, the crystal of the watch or clock must be removed from the face of the clock in order for the individual to "read" the time by use of his tactile senses. At best, it takes several seconds for an individual to "tell" the time by the braille system of the prior art. Moreover, the braille tactile code is not adaptable to the hearing sense, and braille has no single or discrete character for "ten," "eleven," and "twelve."

SUMMARY OF THE INVENTION

This invention comprises electronic or electromechanical means for enabling a person with a visual handicap to tell the time by means of a serial readout. The time is read out in a serial manner with the hour being read out first, followed by the minutes after the hour.

The specific read out is given in response to a command by the individual, which is simply the activation of the readout mechanism by an appropriate switch. The time is given in a digit code which consists of a series of dot and dash characters, with a maximum of three characters per digit. Readout may be accomplished by reference to an individual's tactile senses, such as the motion of a small hammer or the like against a finger, or readout may be accomplished with reference to audio senses, as by sounds of a specific frequency in the same dot and dash code as used for tactile readout.

Among the objects of the present invention are the following:

to provide new and useful time keeping apparatus;

to provide new and useful time keeping apparatus for visually handicapped persons;

to provide new and useful apparatus for the serial readout of time;

to provide new and useful apparatus in which time is read out by reference to tactile senses;

to provide new and useful apparatus for the readout of time information;

to provide new and useful time readout apparatus in which audible signals are provided;

to provide new and useful timekeeping apparatus in which time is read out in response to a specific command therefor;

to provide new and useful apparatus in which time is read out in the form of coded information; and to provide new and useful electromechanical apparatus for the serial readout of coded time information.

FIG. 9 is a schematic circuit diagram of the Code Assembler of the apparatus of the present invention shown in FIG. 1.

DESCRIPTION OF THE PREFERRED EMBODIMENT

Introduction

Figure 1:
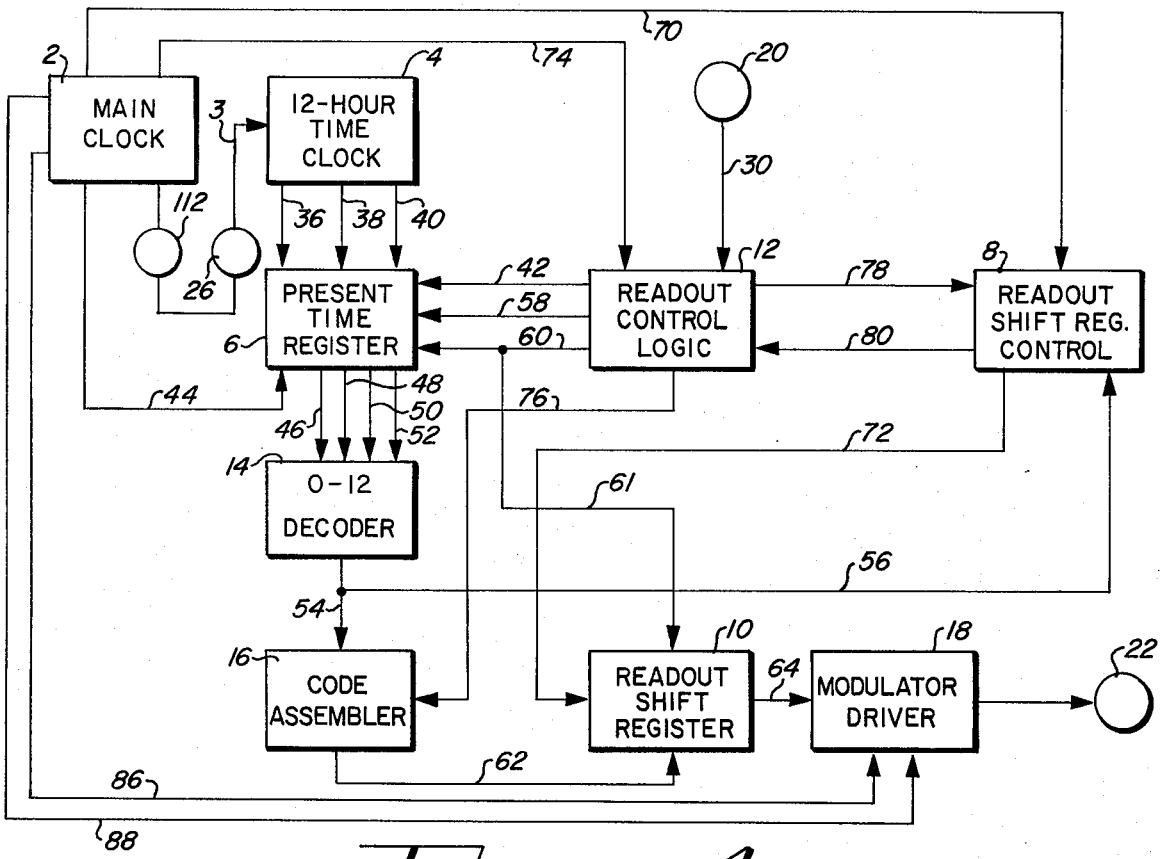
FIG. 1 is a schematic block diagram of apparatus embodying the present invention.

The present invention comprises horological or time keeping apparatus for reading out the present time either by a mechanical movement perceptible to the tactile or touch sense of an individual or by an audible signal of a frequency perceptible to the human ear. FIG. 1 comprises a schematic block diagram of the apparatus for accomplishing the time keeping and readout functions. The figure is a block diagram which includes the major components and the circuitry connectors or connecting paths for the respective signals between each of the major components. Arrows on the connectors indicate the direction of travel for each signal. Nine major components are shown, and they are as follows:

Main Clock, identified by reference numeral 2;

Twelve Hour Time Clock, identified by reference numeral 4;

Present Time Register, identified by reference numeral 6;

Readout Shift Register Control, identified by reference numeral 8;

Readout Shift Register, identified by reference numeral 10;

Readout Control Logic, identified by reference numeral 12;

Zero Through Twelve Decoder, identified by reference numeral 14;

Code Assembler, identified by reference numeral 16; and

Modulator Driver, identified by reference numeral 18.

In addition to the items listed above, there are three mechanical or electro-mechanical components which are also needed. The first component comprises an on-off switch 20 which actuates the apparatus to provide a time readout signal. This switch is normally off and when manually activated by the user causes a beginning signal, in the form of a low level voltage, to be generated. The low level voltage signal in turn activates the apparatus to provide a readout or code output of time. From the switch 20, the signal is transmitted to the Readout Control Logic by conductor 30.

The second component is the actual readout apparatus. As indicated above, this may be an electromechanical apparatus 22 which causes a tactile sensation to the user, as by moving a mechanical lever or pin against a finger or other member of the body. If desired, the readout apparatus 22 could also, or alternatively, provide an audible signal, such as a tone of a desired frequency.

Figure 3:
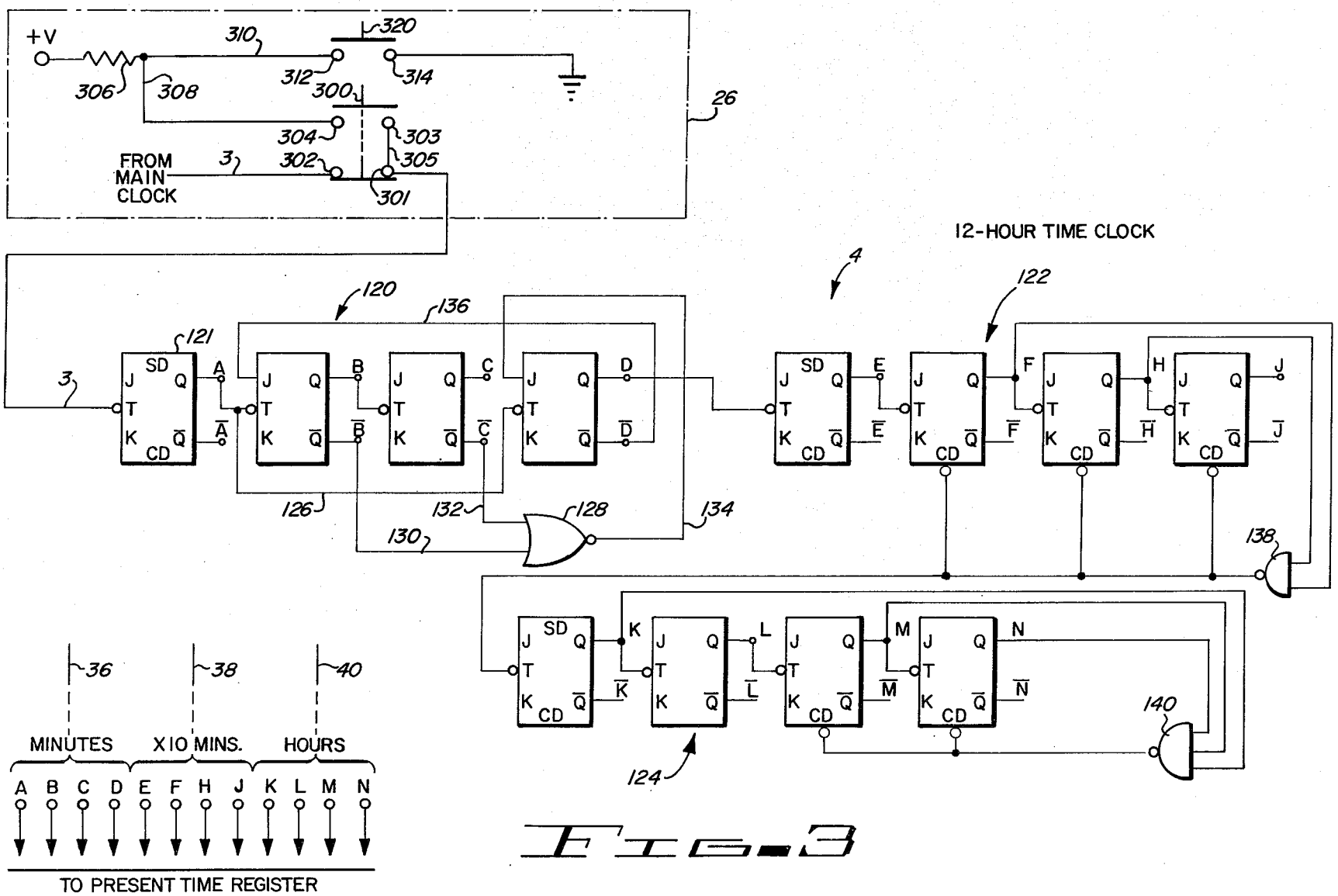
FIG. 3 is a schematic circuit diagram of the Twelve Hour Time Clock of the present invention shown in FIG. 1.

Setting the time is accomplished by either of two methods, the first of which is through the Main Clock by a switch in a set time mechanism, and the second of which is through the minutes counter of the Twelve Hour Time Clock by a switch 26 (see FIG. 3).

A brief overview of the apparatus will be given in conjunction with FIG. 1, and then the individual major components will be discussed with reference to circuit or logic diagrams, comprising FIGS. 2 through 13, for each of the major components.

The Main Clock 2 is a 100 KHz oscillator with a number of divide down counters to bring the 100 KHz down to 1 cycle per minute. The 1 cycle per minute output from the Main Clock 2 is sent by conductor 3 to a Twelve Hour Time Clock 4 to increment its counters.

The Twelve Hour Time Clock 4 has three primary counters, one for minutes, one for 10 minutes or 10 minute increments, and one for hours. Since the 10 minute increment comprises 10 one minute intervals or increments, the time period counted is 1 minute "times 10" and will sometimes hereinafter be referred to as "times 10" and the counter thus counting may sometimes hereinafter be referred to as the "Times Ten Minutes Counter." The Minutes Counter counts a decade, or zero through 9, and it then resets to zero.

The output from the Minutes Counter goes to and increments a Ten Minutes counter which counts zero through five 10 minute intervals. It is reset back to zero when it reaches a count of six, or once every hour. The output from the Ten Minutes Counter goes to the Hour Counter to increment the Hour Counter once every hour. The Hour Counter is reset to one (one o'clock) when it reaches a count of thirteen.

In operation, the Minutes Counter counts a total of 10 minutes which results in a single output to the Ten Minute Counter, and it comprises a 10 minute increment. The Ten Minute Counter then counts a total of 60 minutes, or from zero to five 10 minute increments, which is a total of one hour. Its output in turn increments an Hours Counter which counts hours from one to 12 and upon reaching 13 it is reset to one.

Accordingly, by way of illustration, the time may be read from the apparatus in terms of hours, 10 minutes after the hour, and minutes after a particular 10 minute interval, such as twelve-four-five for 12:45. As time continues, the Minutes Counter, at a count of 10 for the minutes, increments the Ten Minutes Counter to read 5 (for 50 minutes) in the next sequence. Upon the completion of the count to 12:59, the counter moves to one o'clock (1:00) on the next full counting sequence, which comprises each a minute, a 10 minutes, and an hour sequence.

The output signals from the Twelve Hour Time Clock 4, in the form of minutes, 10 minutes, and hours, moves from the Twelve Hour Time Clock 4 to the Present Time Register 6, which is a 12 bit parallel input shift register. Each input, in terms of minutes, 10 minutes, and hours, requires four conductors for shifting appropriate information bits, for a total of 12 bits, in the register. The respective output/input signals in minutes, 10 minutes, and hours, from the clock 4 to the register 6, are represented by reference numerals 36, 38, and 40.

Before time can be transferred from the Twelve Hour Time Clock 4 to the Present Time Register 6, a clear signal is initiated by the Readout Control Logic 12 and sent to the Present Time Register 6 through conductor 60 and at the same time the clear signal is sent to the Readout Shift Register 10 through conductor 61. The clear signal is necessary to clear and precondition the two units so that the readout of the present time is not affected by information left from a previous time readout.

Subsequently the time from the Twelve Hour Time Clock 4 is caused to be loaded into the Present Time Register 6 by a pair of signals, one comprising a Load Time signal through conductor 42 from the Readout Control Logic 12 and an Enable Loading signal through conductor 44 from the Main Clock 2. After loading the time into the Present Time Register 6, the output from the Register 6 is immediately available to the Zero Through Twelve Decoder 14. The present hour time from the Present Time Register 6 goes to the Zero Through Twelve Decoder first by way of conductors 46, 48, 50, and 52. It is then transmitted to the Code Assembler 16 and to the Readout Shift Register Control 8 through conductors 54 and 56, respectively, shown in FIG. 1, each of which actually comprises 13 conductors. In the Zero Through Twelve Decoder, each of the four inputs 46, 48, 50 and 52 to the Decoder 14 from the Present Time Register 6 is assigned a value of 1, 2, 4or 8, respectively, comprising a possible total value of 0 through 15 in a binary coded decimal form. Thus the respective input bits from the Present Time Register to the Zero Through Twelve Decoder are decoded as a series of decimal numbers 0 through 12. The decoded decimal numbers then move to the Code Assembler 16 through one of thirteen conductors represented by 54. The Code Assembler 16 translates the decimal numbers into a special code which is used for the output of the time keeping apparatus. After the present hour is transmitted by the apparatus, four shift pulses, comprising a Shift Next Digit signal, are received by the Present Time Register 6 from the Readout Control Logic 12 through conductor 58 to enable transmission of the present 10 Minutes Digit by the apparatus, and the same Shift Next Digit signal is repeated to enable transmission of the present minutes digit over the same conductors as the hours and times ten minute digits.

From the Code Assembler 16, the assembled special code for the hour, 10 minutes, and minutes is transmitted in parallel to the Readout Shift Register through 13 conductors 62. The Readout Shift Register 10 then transmits serially to the Modulated Driver 18 the special code by way of conductor 64. The Readout Shift register in effect takes the assembled code (in the form of 13 individual and simultaneously present voltage levels) from the Code Assembler 16 and transmits to the Modulator Driver 18 the thirteen individual voltage levels one at a time over conductor 64. The Modulator Driver 18 then takes the time code (now in serial form) as received from the Readout Shift Register 10 and converts it to the proper voltage and frequency to drive the electromechanical Modulating Device 22.

In order to set the time, the main one cycle per minute output from the Main Clock can also be changed to 600 cycles per minute whenever it becomes necessary to set the time. This in effect speeds up time for purposes of resetting or changing the time.

Referring again to the Main Clock 2, a 5 cycles per second (Hz) signal from the Main Clock is transmitted by conductor 70 to the Readout Shift Register Control 8. This signal is used to provide shift pulses over conductor 72 from the Readout Shift Register Control 8 to the Readout Shift Register 10.

Another output from the Main Clock is transmitted by conductor 74 as a 10 KHz pulse to the Readout Control Logic 12. The Readout Control Logic 12 comprises the logic used to initiate and to implement the control of the transmission of all time codes to the Modulator Driver 18. The 10 KHz clock signal from the Main Clock through condutor 74 is used to increment a 0 through 31 binary ripple counter in the Readout Control Logic. From this counter, the following times are decoded or are taken from the counter and used to determine the implementation of certain signals. The times are as follows:

| | | | |
|---|---|---|---|
| T1 | clear | T17 | start transmission of digit |
| T2 | load time | T19 | shift pulse } Minutes digit |
| T3 | enable code assembler | T21 | shift pulse } Minutes digit |
| T5 | start transmission of digit | T23 | shift pulse } Minutes digit |
| T7 | shift pulse } times ten minute digit | T25 | shift pulse } Minutes digit |
| T9 | shift pulse } times ten minute digit | T27 | enable code assembler |
| T11 | shift pulse } times ten minute digit | T29 | start transmission of digit |
| T13 | shift pulse } times ten minute digit | T31 | stop |
| T15 | enable code assembler | | |

This is a total of 17 discrete times that are decoded from the Readout Control Logic and which signal or control the implementation of certain events in specific sequences.

Five specific signals are transmitted from the Readout Control Logic and signal or control the implementation of certain events in specific sequences.

Three specific signals are transmitted from the Readout Control Logic 12 to the Present Time Register 6. They are the Load Time, Shift Next Digit, and Clear signals, respectively, through conductors 42, 58, and 60, as previously stated. An Enable Code Assembler signal is transmitted from the Readout Control Logic 12 through conductor 76 to the Code Assembler 16.

From the Readout Control Logic 12 a Start Transmission of Digit signal is transmitted by conductor 78 to the Readout Shift Register Control 8, and in turn the Readout Shift Register Control 8 sends a signal designated as Shift Next Decimal Digit to the Readout Control Logic 12 by conductor 80.

The Readout Shift Register Control 8 also includes a 0 through 31 binary ripple counter. It is incremented by the 5 cycles per second clock pulses coming from the Main Clock 2 by conductor 70. Nine times are decoded from this counter. They are the T13, T15, T16, T18, T19, T20, T21, T23, and T25. These particular times determine the number of 5 cycles per second shift pulses transmitted to the Readout Shift Register 10 in order to shift from the Readout Shift Register a particular digit code along with the time between digits. The logic is only able to determine the correct number of shift pulses to send to the Readout Shift Register 10 (conductor 72) by the introduction of the particular decimal number to be transmitted. This is accomplished by the 13 conductors 56 from the Zero Through Twelve Decoder 14. We have one conductor for each number 0 through 12. The number to be transmitted is ANDed together with the appropriate decoded time from the 0 through 31 counter. We now have logic which is capable of supplying a predetermined number of shift pulses for any particular number 0 through 12.

The Readout Shift Register Control 8 determines the significant times for each coded number according to the appropriate code used in the readout of the time. The following table shows an example of a code comprised of a series of dots and dashes and which is illustratively used herein with respect to the times for a particular sequence of digits.

1 .
2 ..
3 ...
4 -
5 --
6 ---
7 .-
8 -.
9 .-.
10 -.-
11 ..-
12 --.
0 .--

The above code will be graphically illustrated in conjunction with FIG. 10 and further explanation will be given below.

From the Main Clock, two conductors, conductor 86 and conductor 88, extend to Modulator Driver 18. The conductors transmit signals of 1000 Hz and 100 Hz, respectively, for readout signals, as desired.

If an audible output is desired, conductor 86 is used to transmit a 1000 Hz signal to a mixer and amplifier in the Modulator Driver. In this situation, the readout apparatus includes a speaker.

If a tactile readout is desired, the conductor 88 is used to transmit a 100 Hz signal to a mixer and amplifier in the Modulator Driver.

The readout apparatus for this application includes a mechanical vibrator. The vibrator utilizes the 100 Hz signal for a tactile output.

MAIN CLOCK

Figure 2:
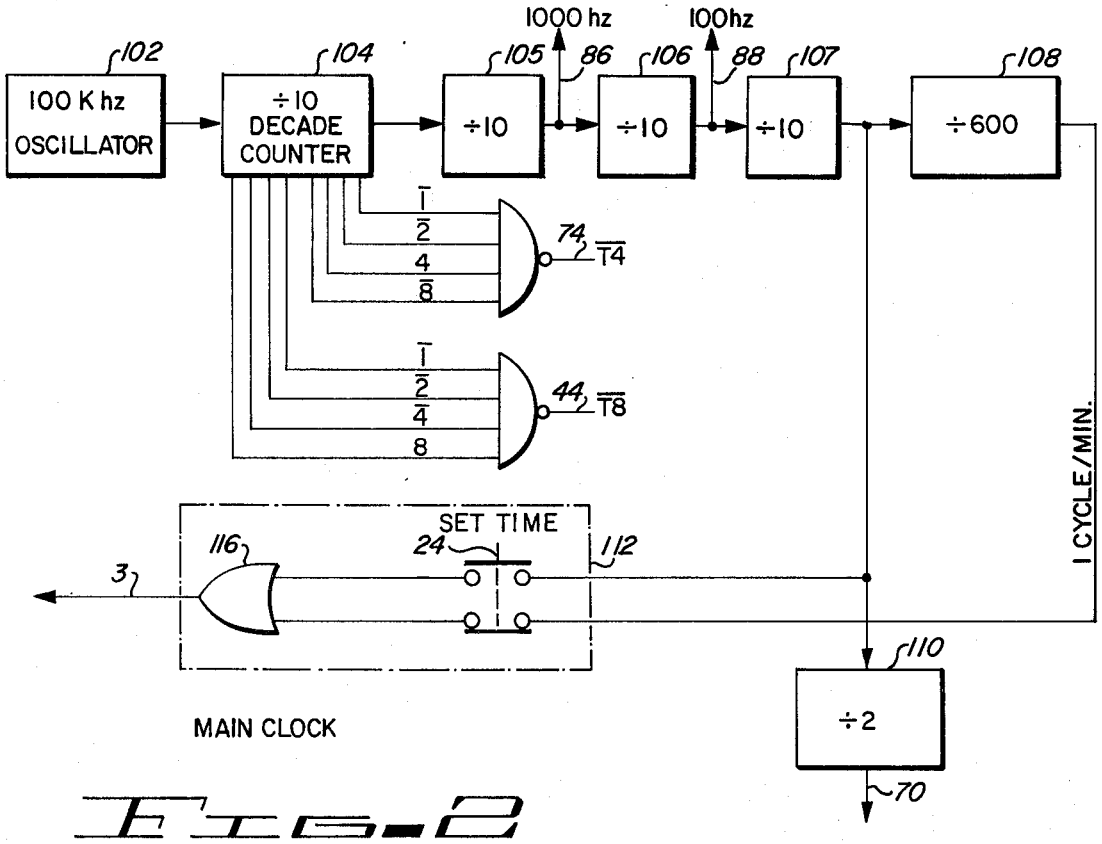
FIG. 2 is a schematic circuit diagram of the Main Clock of the present invention shown in FIG. 1.

The Main Clock 2 in FIG. 2 includes a 100 KHz oscillator 102 with a number of divide down decade counters to reduce the 100 KHz down to desired cycles or repetition rates. The divide down decade counters are well known state of the art devices which each include four JK flip-flops to provide a total count of ten. The binary Q or Q(not) output of each of the JK flip-flops respectively represents the decimal digits 1, 2, 4, and 8. A combination of the various outputs can accordingly be used to count from 0 to 9 for purposes of the present invention, or to count higher if desired for other applications and purposes. The count from 0 to 9 represents a total count of 10, or a decade.

The output from the 100 KHz oscillator 102 is first sent to a divide by 10 decade counter 104. The resulting output from the decade counter 104 is a 10 KHz signal. From the divide by 10 decade counter 104, two times are decoded. The first time output is decoded at T4 and it comprises a 10 KHz clock pulse which is transmitted to the Read-Out Control Logic 12 by conductor 74. This 10 KHz clock pulse is used as the basic clock input signal to a binary counter in the Read-Out Control Logic.

The second time output decoded from the counter 104 is also a 10 KHz output which comprises the EL or Enable Loading signal transmitted to the Present Time Register 6 (see FIGS. 1 and 4) by conductor 44. T8 is used to load the Present Time Register 6 from the Twelve Hour Time Clock 4. The loading of the Present Time Register 6 from the Twelve Hour Time Clock 4 occurs only when the Twelve Hour Time Clock is not in a transition state, which is when it is not incrementing itself according to a change of time. T8 is decoded from the decade counter 104 at a specific time when the Twelve Hour Time Clock is not at a transition period; T8 never occurs at a transition period of the Twelve Hour Time Clock 4.

From the decade counter 104, a 10 KHz signal goes to a series of divide by 10 counters 105, 106, and 107, which comprise the second stage counters in the Main Clock 2. The output from the divide by 10 counter 107 is a 10 Hz signal. This 10 Hz signal is transmitted to three locations. It goes to a divide by 600 counter 108, which comprises a third stage counter in the Main Clock, and it also is transmitted to a divide by 2 counter 110 and to a set time mechanism 112.

Ten Hz, or 10 cycles per second, is the same as 600 cycles per minute. This 600 cycles per minute is used to set the time of the watch by means of a mechanical switch 24 in the set time mechanism 112. When the mechanical switch 24 is actuated, the 600 cycle per minute signal is sent through an OR gate 116 to the Twelve Hour Time Clock 4 (see FIGS. 1 and 2) by conductor 3. The speed of this signal is thus 600 times faster than the normal one cycle per minute signal transmitted to the Twelve Hour Time Clock to increment the clock, as discussed below. This has the effect of speeding up time in order to advance the time in the Twelve Hour Time Clock.

As previously indicated, the 10 Hz signal is also transmitted to a divide by 600 counter 108 which comprises the third dividing or division stage of the Main Clock 2. This divide by 600 results in an output signal of one cycle per minute. The one cycle per minute output signal is sent to the OR gate 116 from the divide by 600 counter 108 through the normally closed contacts of switch 24 of set time mechanism 112 and results in the one cycle per minute signal to the Twelve Hour Time Clock 4 through conductor 3.

Both the 600 cycle per minute and the one cycle per minute signals comprise the inputs for the OR gate 116. The set time mechanism 112 includes a mechanical switch 24 which disconnects the one cycle per minute signal from counter 108 from the OR gate 116 and connects the 600 cycle per minute signal from counter 107 to the OR gate when actuated.

The fourth stage counter or divider in the Main Clock 2 is a divide by 2 counter 110 which receives the 10 Hz signal from counter 107 and reduces it to 5 Hz to provide a 5 cycle per second clock pulse to the Read Out Shift Register Control 8 (see FIGS. 1 and 5) by conductor 70. This 5 cycle per second clock pulse provides the basis for the ultimate time code transmitted to the individual or person activating the readout of the time keeping apparatus.

Five cycles per second may be considered as five discrete time periods of 200 milliseconds each. Using this basic signal of 5 cycles per second and with each cycle comprising 200 milliseconds, the dot and dash code which is used to transmit time is made up of increments of 200 milliseconds. A dot represents a time period of 200 milliseconds; a dash represents a time period of 600 milliseconds, and 400 milliseconds of time is used between each dot or dash. A total of 2.4 seconds, or 2400 milliseconds (ms) separates digits. This will be discussed more in detail in conjunction with the Readout Shift Register Control 8 and the Readout Shift Register 10 (see FIGS. 1, 5, and 6), and is illustrated in FIG. 10.

The divide by ten counter 105 produces a 1000 Hz output signal which comprises an audio tone for an audio readout. In this situation, the Main Clock, or portions thereof, comprises an output oscillator.

The next divide by 10 counter 106 produces a 100 Hz output signal which may be used with an output transducer to provide a tactile output. Again, portions of the Main Clock may comprise an output oscillator.

From counter 105, conductor 86 transmits the 1000 Hz signal to Modulator Driver 18 (see FIG. 1) and to audio amplifier and speaker apparatus associated therewith. Conductor 88 transmits a 100 Hz signal from counter 106 to the Modulator Driver 18 (see FIG. 1) and to a tactile amplifier and output apparatus associated therewith. The Modulator Driver apparatus will be discussed in detail, below.

TWELVE HOUR TIME CLOCK

The Twelve Hour Time Clock in FIG. 3 includes three counters 120, 122, and 124, respectively for minutes, for times 10 minutes, and for hours. These counters are well known state of the art binary ripple counters, each of which includes four JK flip-flops, respectively flip-flops A, B, C, and D, and flip-flops E, F, H, and J, and flip-flops K, L, M, and N. Decoding is included in each of the counters to set or to reset their state at certain counts.

The input signal to the Twelve Hour Time Clock 4 is the one cycle per minute input signal from the Main Clock 2 on conductor 3. It is supplied to the trigger or clock input of the first JK flip-flop, flip-flop A, in the minutes counter 120. The circuitry in the minutes counter 120 is arranged so as to count to a decade of 0 through 9. The minutes counter accordingly counts a total of 10 minutes. The 10 minute increment is then transmitted to the 10 minutes counter 122 as the input signal to that counter.

The Q outputs of each of the four JK flip-flops, A, B, C, and D, in the minutes counter 120, are transmitted directly to the Present Time Register 6 (see FIGS. 1 and 4) in parallel, as shown in the table at the lower left of FIG. 3. That is, the Q output from JK flip-flop A, from JK flip-flop B, from JK flip-flop C, and from JK flip-flop D, each go directly to a flip-flop in the Present Time Register 6. In addition, the Q outputs and also the Q(not) outputs of the various flip-flops are connected together as shown in the figure. The A output is sent to the clock input of the B flip-flop, and also is connected to the clock input of the D flip-flop by conductor 126. The B output is connected to the clock input of the C flip-flop. The B(not) output is connected to an OR gate 128 by connector 130, as is the C(not) output by conductor 132. The inverted output signal from the OR gate 128 is transmitted to the J input of the D flip-flop by conductor 134. The D(not) output is in turn connected to the J input of the B flip-flop by conductor 136. Accordingly, the minutes counter 120 is set to increment a count of "one" each minute from 0 to 9 minutes. After the incrementing of the ninth minute, which is a total count of 10 minutes, the D output is transmitted to the clock input of the E flip-flop in the times 10 minutes counter 122. The D Q output is a single count for the times 10 minutes counter.

At a count of 10 the counter is set to a count of 0 from a count of 9. The count of 10 never gets set in the counter and only exists momentarily. Output D then clocks low every 10 minutes and a signal is sent to the clock input of the E flip-flop in the times 10 minutes counter 122. Accordingly, the 10 minutes counter 122 is incremented once every 10 minutes.

The 10 minute counter 122 is decoded at its count of 6 and reset back to 0. This count of 6 is decoded by the AND gate 138 from flip-flops F and H. As previously indicated, the clock input for flip-flop E, the first flip-flop in the 10 minutes counter 122, is the Q output from the D flip-flop in the minutes counter. This Q output clocks low every 10 minutes. The Q output of flip-flop E is connected to the clock input lead of the F flip-flop, and F output is connected to the clock input of the H flip-flop, and the H output is connected to the clock input of the J flip-flop.

As with the minutes counter, the Q outputs of each of the flip-flops in the 10 minutes counter are connected directly to flip-flops in the Present Time Register 6 (see FIGS. 1 and 4) as shown in the table at the lower left of the figure. The Q outputs from flip-flops F and H are also connected to an AND gate 138, the inverted output from which is connected to the clear direct leads of the F, H, and J flip-flops in the 10 minutes counter. This arrangement resets the counting back to 0 at a count of 6. It should be noted that the count of 6 is only momentary and does not exist in the counter long enough to be sent to the Present Time Register. The only proper counts for this counter are 0 through 5. The inverted output of AND gate 138 also goes to the clock input of the K flip-flop in the hour counter 124 to increment it once every hour.

The hours counter 124 also includes four flip-flops, designated K, L, M, and N. The Q outputs from the K, L, and M flip-flops are connected directly to the clock inputs of the next adjacent flip-flops, the L, M, and N flip-flops, respectively. The Q outputs from the K, M, and N flip-flops are transmitted to an AND gate 140, the inverted output of which is connected to the clear direct lead of the M and N flip-flops. With this circuitry, a count of 13 is decoded from the hours counter 124. At an incremental count of 13, the hours counter is reset to 1 by AND gate 140. In this manner, a total of 12 hours may be counted by the hours counter.

As with the minutes and times 10 minutes counter, as shown in the table, the Q outputs from the flip-flops in the hours counter 124 is sent directly to flip-flops in the Present Time Register 6. In this manner the present time is generally immediately available to the Present Time Register 6 in parallel from the Twelve Hour Time Clock 4. However, as discussed previously in conjunction with FIG. 2, the Enable Loading (EL) signal, which allows the Present Time Register 6 to be loaded from the Twelve Hour Time Clock, originates from the divide by 10 decade counter 104 in the Main Clock (see FIG. 2). This occurs at a count of 8 in that particular decade counter which is a time when the Twelve Hour Time Clock is not incrementing itself. The Twelve Hour Time Clock is incremented at a count of 10 by that counter. That is, at the count of 8 from the decade counter 104, the Twelve Hour Time Clock is not in a transition, either a minute transition, a times 10 minutes transition, or an hour transition.

MANUAL TIME SETTING SWITCHES

Included in the set time apparatus 112 of FIG. 2, in addition to the spring loaded switch 24 normally connecting the 1 cycle per minute signal from the divide by 600 counter 108 to conductor 3 and to the minutes counter 120 of the Twelve Hour Time Clock (see FIG. 3), and alternately connecting a 10 cycles per second signal to conductor 3 and to the minutes counter, there is also another time setting apparatus 26. This other time setting apparatus 26, shown in detail in FIG. 3, allows the incrementing of the minutes counter by a single minute using another pair of spring loaded switches.

Conductor 3 extends from the Main Clock to the clock input or trigger terminal of flip-flop A, the first flip-flop in the minutes counter 120 of the Twelve Hour Time Clock (see FIG. 3). A switch 300 is across the conductor 3. The switch includes a pair of terminals 301 and 302 both of which are connected to conductor 3. The switch 300 is spring loaded across the terminals 301 and 302 for normal operation of the time keeping apparatus. The switch also includes a pair of terminals 303 and 304. Terminals 301 and 303 are connected by a conductor 305. Thus terminal 303 is connected to conductor 3 adjacent flip-flop A through conductor 305 and terminal 301.

Terminal 304 is connected to a positive voltage source through an appropriate resistor 306 and conductor 308. A conductor 310 extends from the resistor 306 and the conductor 308 to a terminal 312 of switch 320. The switch 320 includes another terminal 314 which is connected to ground. The switch 320 is spring loaded to the open or off position.

To increment the flip-flop 121 by a single minute, both switches 300 and 320 must be manually actuated or depressed. The switch 300 must be manually actuated to disconnect the Main Clock from conductor 3 and to connect the positive voltage source of the manual time setting apparatus to the conductor 3. When the switch 320 is actuated, the voltage source is connected to ground and the grounding pulse, connected to the clock input of flip-flop 121, thus increments the minutes counter by a single minute.

The switch 320 must be manually actuated one time for each minute. When the desired time is set into the time keeping apparatus the switch 300 is released to reconnect the main clock to conductor 3 and to the minutes counter.

PRESENT TIME REGISTER

Figures 4, 8:
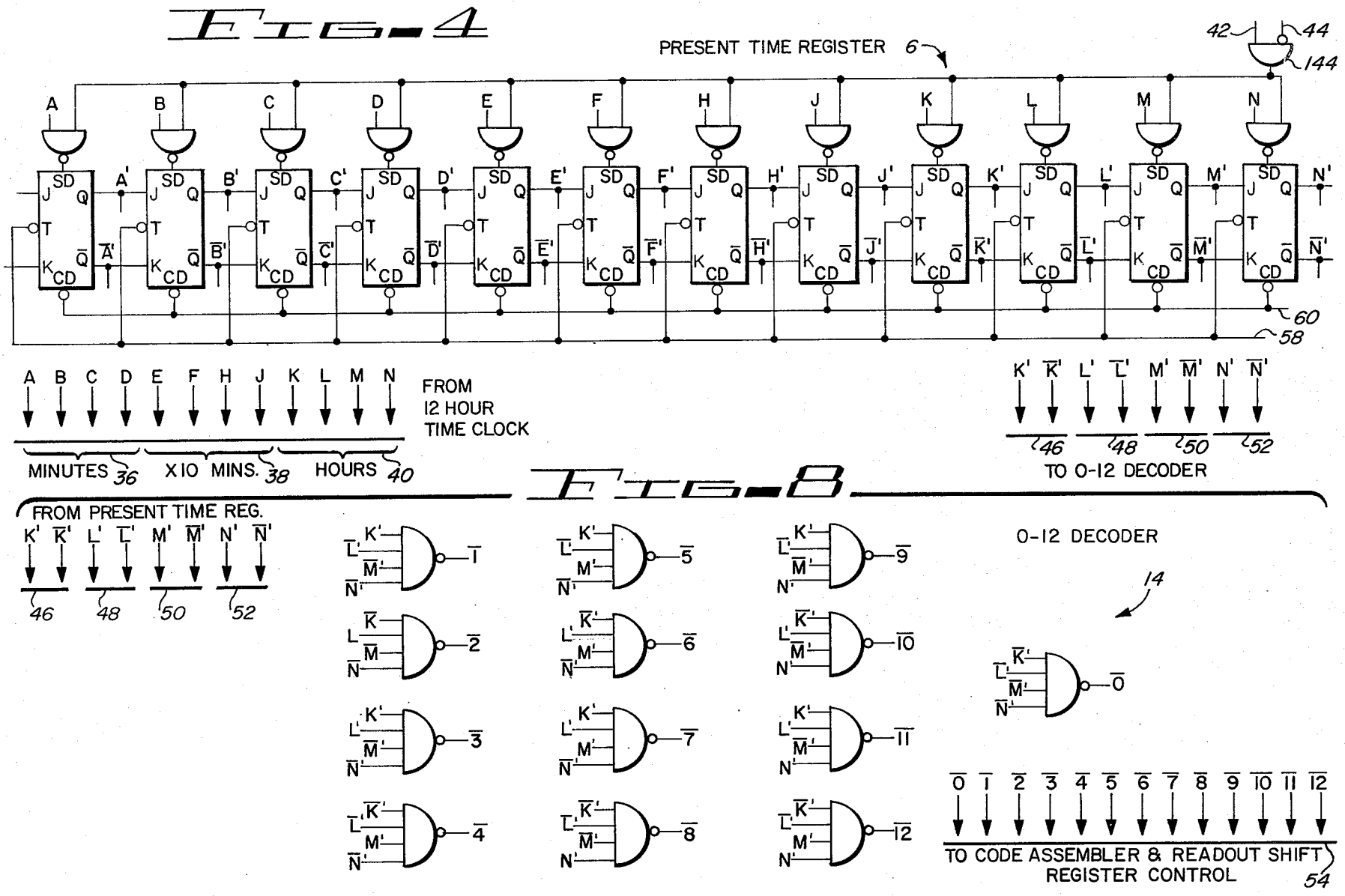
FIG. 4 is a schematic circuit diagram of the Present Time Register of the apparatus shown in FIG. 1.
FIG. 8 is a schematic circuit diagram of the Zero Through Twelve Decoder of the present invention shown in FIG. 1.

The Present Time Register 6 of FIG. 4 comprises a 12 bit parallel input shift register. Twelve flip-flops are used for the bits, with four bits, or four flip-flops, respectively used for loading minutes, times 10 minutes, and hours. The binary coded decimal system used in counting in the present apparatus has previously been explained and is well known in the art, with the output from the first bit or flip-flop representing a 1, the output from the second bit or flip-flop representing a 2, the output from the third flip-flop or bit representing a 4, and the output from the fourth bit or flip-flop representing an 8. Thus the combinations of the respective flip-flops are used to represent decimal numbers, as required, from 0 to 12. That is, the hours decimal digits go from 1 to 12, the 10 minutes digits go from 0 to 5, and the minutes digits go from 0 to 9. Thus with the appropriate combinations, any particular time for any particular minute can be represented for a 12 hour period.

The 12 flip-flops in the Twelve Hour Time Clock 4 (see FIG. 3) were given alphabetic designations of A, B, C, D, E, F, H, J, K, L, M, and N. The corresponding flip-flops in the Present Time Register are designated by the same alphabetic designation with a prime (′). As previously discussed, the Q output from each of the flip-flops in the counters in the Twelve Hour Time Clock 4 are connected directly to a flip-flop in the Present Time Register. The outputs from the Twelve Hour Time Clock flip-flops thus comprise inputs into the Present Time Register 6. Each input is sent to an AND gate with the same alphabetic designation as the flip-flop to which it is connected. The inverted output of each AND gate is connected to the set direct lead of the respective flip-flops in the Present Time Register. Each AND gate has another input and each of these other inputs is connected together in parallel and thus one signal enables all the AND gates, providing any particular AND gate also receives a qualifying input signal from its corresponding flip-flop in the Twelve Hour Time Clock.

The enabling input which is sent in parallel to all flip-flops in the Present Time Register is from an AND gate 144 which has two inputs, the Load Time or LT signal from the Readout Control Logic 12 (see FIGS. 1 and 7) on conductor 42 and the inverted Enable Loading or EL(not) signal from the Main Clock 2 (see FIGS. 1 and 2) on conductor 44. This latter signal has been discussed previously, and it comprises the T8(not) output from the decade counter 104 in the Main Clock 2 (see FIG. 2). Thus to record the present time from the Twelve Hour Time Clock into the Present Time Register 6, an Enable Loading signal 44 is required from the Main Clock 2 in coincidence with the Load Time signal 42 from the Readout Control Logic. These two signals then qualify AND gate 144 which in turn loads the time from the Twelve Hour Time Clock into the Present Time Register.

The enabling signal to each AND gate comes from the AND gate 144, the inputs of which are derived from the Load Time or LT signal from the Readout Control Logic and the Enable Loading or EL(not) signal from the Main Clock. Accordingly, three signals are required to load time from the Twelve Hour Time Clock into the Present Time Register. The first two signals are the LT and the EL(not) signals which in turn result in an output from an AND gate 144 which enables all AND gates at each of the flip-flops in the Present Time Register. In addition, each AND gate at the respective flip-flops requires a qualifying input signal from the corresponding flip-flops from the Twelve Hour Time Clock in order to set direct each flip-flop in the Present Time Register.

Thus when an hour signal comes from flip-flops K, L, M, or N in the Twelve Hour Time Clock to flip-flops K′, L′, M′, or N′ of the Present Time Register 6 the respective flip-flops will not automatically be set according to their input signals from the Twelve Hour Time Clock, but they will require a precise enabling signal from both the Readout Control Logic and the Main Clock in order to allow the input of time from the Twelve Hour Time Clock to be set into the flip-flops of the Present Time Register. This is also true with the flip-flops for the 10 minutes and the minutes sections of the Present Time Register.

The present time information, or input, from the Twelve Hour Time Clock 4 comes into the Present Time Register 6 in parallel, as shown by the table at the lower left of FIG. 4, and the output from the Present Time Register 6 also is transmitted out in parallel, as shown by the table at the lower right of FIG. 4. The Q and Q(not) outputs from the flip-flops are connected to the zero through twelve Decoder.

Figure 7:
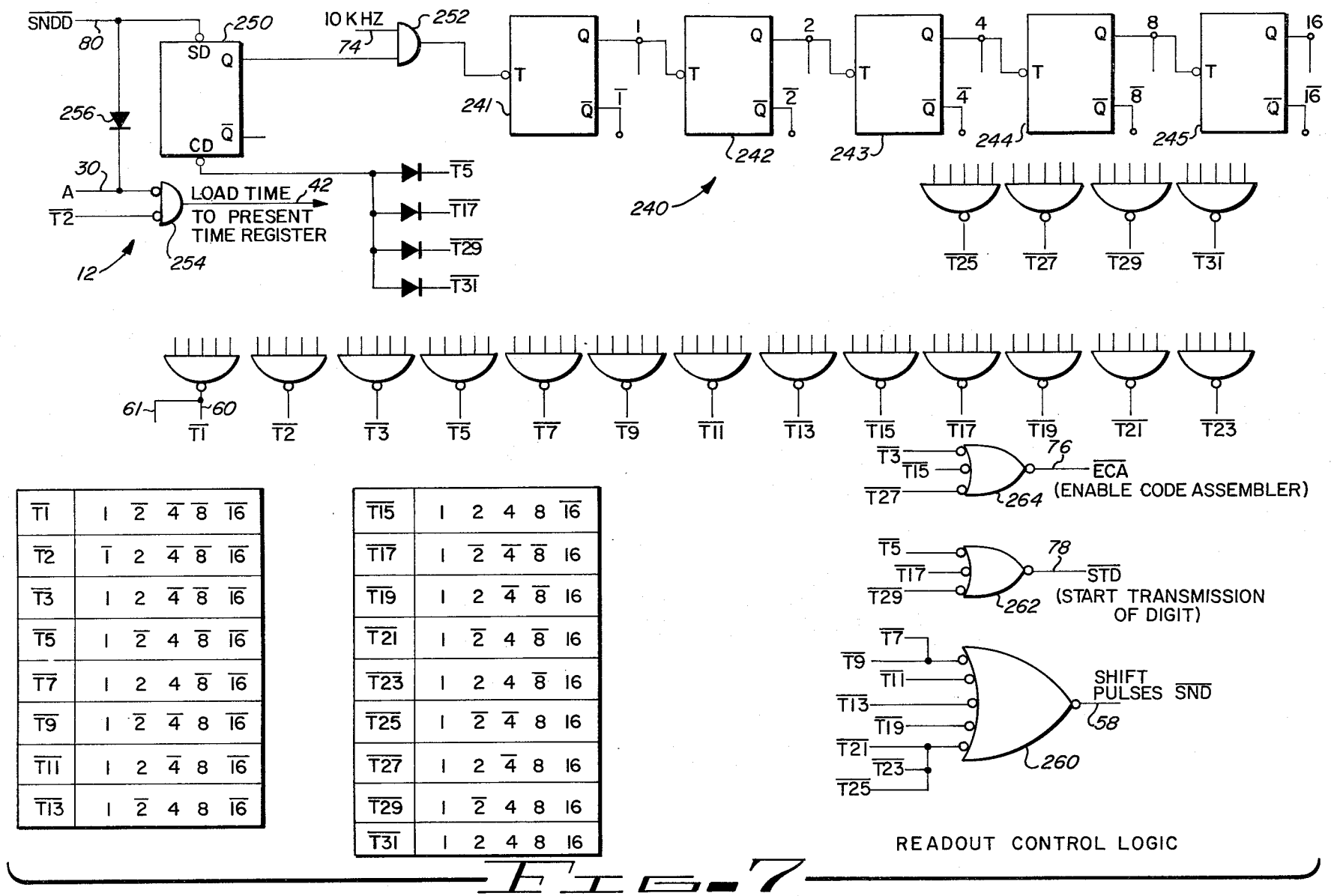
FIG. 7 is a schematic circuit diagram of the Readout Control Logic of the apparatus of the present invention shown in FIG. 1.
Figure 5:
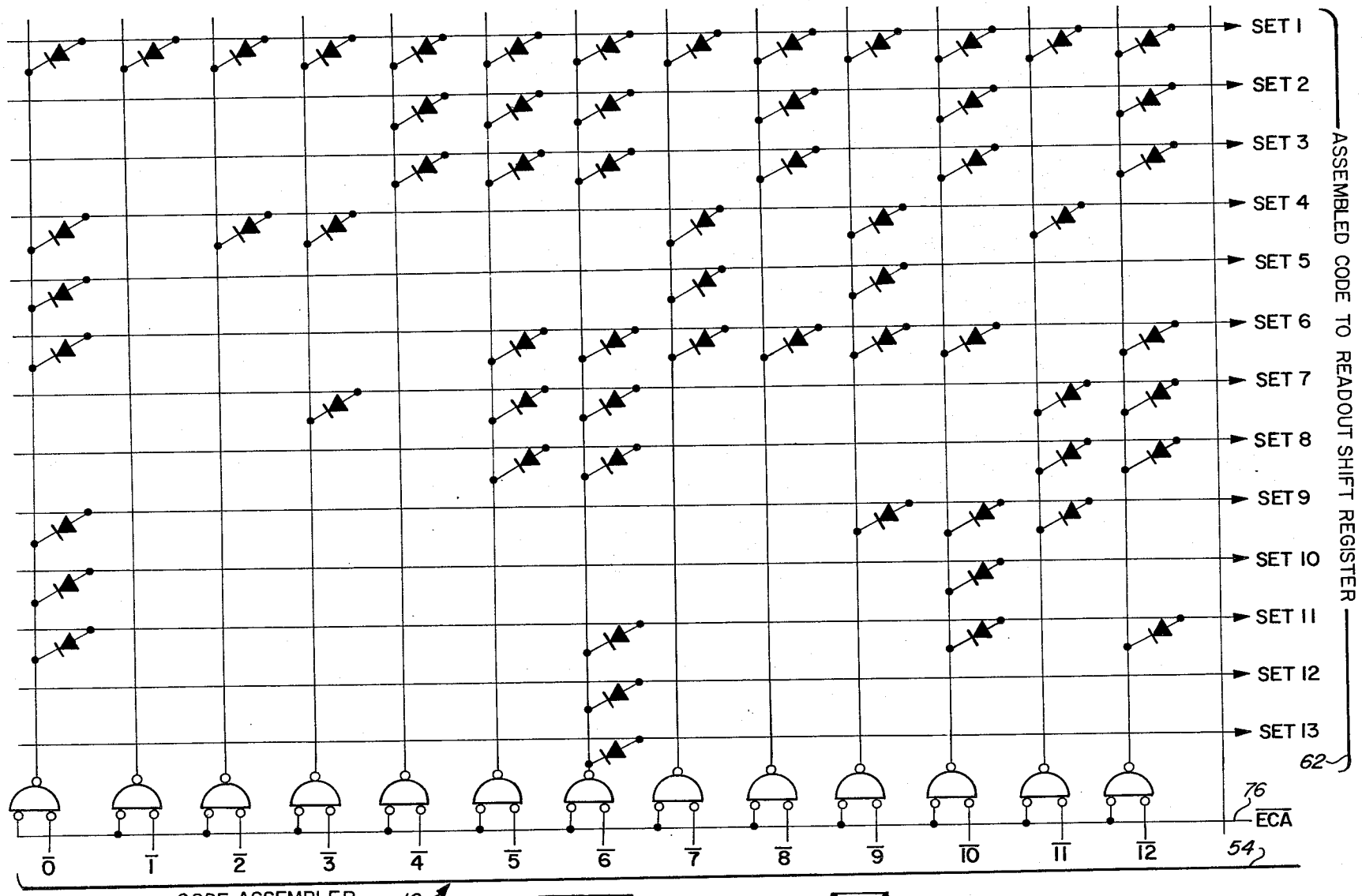

The shifting of the information by the pulses from the respective flip-flops of the Present Time Register is accomplished by shift pulses from the Readout Control Logic (see FIG. 7). The shift pulses are a series of four shift pulses which comprise the Shift Next Digit signal from the Readout Control Logic 12 on conductor 58. The Shift Next Digit pulses are connected to the clock terminals of each flip-flop. The clock terminals of each flip-flop are connected in parallel so that the shift pulses are transmitted simultaneously to the clock leads of the flip-flops. The shift pulses in turn result in the information stored in each flip-flop being transmitted or shifted to their adjacent flip-flops. Since the Shift Next Digit signal comprises a series of four pulses, the time may be read from the Present Time Register to the Zero Through Twelve Decoder sequentially according to the hours, times 10 minutes, and minutes from flip-flops K, L, M, and N. After the present hour has been transmitted, the Shift Next Digit signal of four shift pulses from the Readout Control Logic is received in the Present Time Register and this signal makes the times 10 minutes move over four places to flip-flops K, L, M, and N, thus making the times ten minutes information available to the Zero Through Twelve Decoder. The second Shift Next Digit signal of four shift pulses then in turn makes the minutes available to the Zero Through Twelve Decoder through flip-flops K, L, M and N.

At time T1 in the Readout Control Logic (see FIG. 7), as will be discussed below, a Clear signal is transmitted to the clear direct lead of each flip-flop in the Present Time Register which is connected to conductor 60. This clears the flip-flops of previous time information stored in them in preparation for the new time input from the Twelve Hour Time Clock.

The information to the Present Time Register is transmitted in parallel from the Twelve Hour Time Clock, as shown in the table at the lower left in FIG. 4. That is, the Q output from flip-flops A, B, C,... L, M, and N of the Twelve Hour Time Clock is connected directly to the AND gates associated with each flip-flop A′, B′, C′,... L′, M′, and N′ of the Present Time Register. The output of the Present Time Register is transmitted to the Zero Through Twelve Decoder in parallel from the four hour flip-flops, which are the K′, L′, M′, and N′ flip-flops.

The Present Time Register, as previously indicated, is a 12 bit shift register. The first Shift Next Digit signal 58, which comprises a series of four shift pulses from the Readout Control Logic, is connected to the clock terminals of each flip-flop in the Present Time Register. Accordingly, the information stored in each flip-flop is shifted to the adjacent flip-flop by the Shift Next Digit signal from the Readout Control Logic. This shift occurs four times, once for each of the four pulses. Thus, an entire digit is shifted to the right four times. The times 10 minutes thus gets put into the four hour flip-flops and the minutes gets put into the four times 10 minutes flip-flops.

Both the Q and the Q(not) outputs from the hour flip-flops K′, L′, M′, and N′ are connected to the Zero Through Twelve Decoder. Accordingly, any information contained in flip-flops K′, L′, M′, and N′ is made immediately available to the Zero Through Twelve Decoder 14 (see FIG. 8) whether the information is an hours digit, a times 10 minutes digit, or a minutes digit. Shifting from the A′ through J′ flip-flops to the K′ through N′ flip-flops is in response to the SND signals or shift pulses on conductor 58.

READOUT SHIFT REGISTER CONTROL

Figure 5:
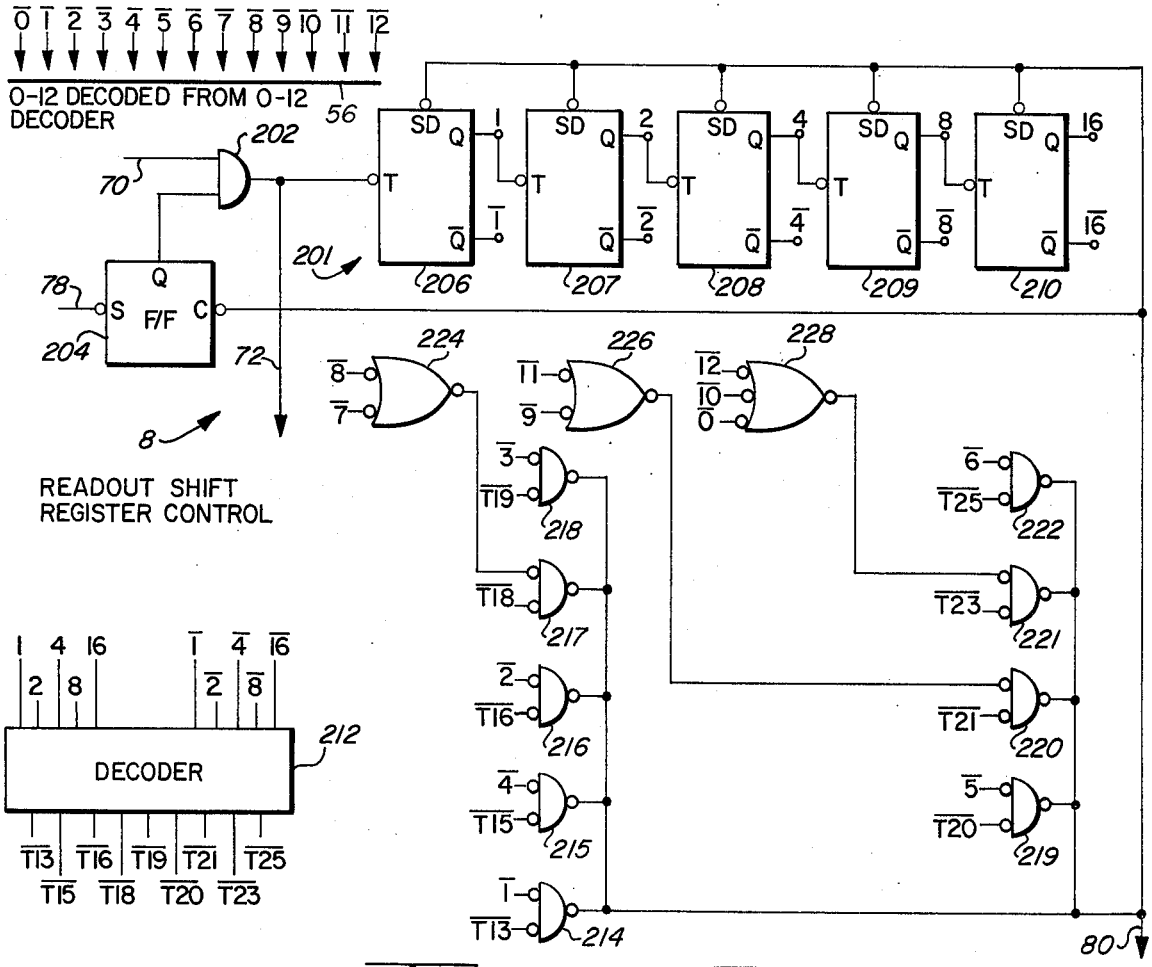
FIG. 5 is a schematic circuit diagram of the Readout Shift Register Control shown in FIG. 1.

The Readout Shift Register Control is schematically shown in FIG. 5. The Readout Shift Register Control 8 includes a binary ripple counter 201, such as has been previously described, and is well known in the art, which counts from zero through 31. The counter is incremented from the Main Clock by the five cycles per second output on conductor 70. The ripple counter includes five flip-flops, numbered 206, 207, 208, 209, and 210. The Q output from each is successively connected to the clock input of the next adjacent flip-flop.

The ripple counter is enabled from an AND gate 202, one of whose inputs is the five cycles per second signal 70 from the Main Clock 2 (see FIGS. 1 and 2) and the other of whose inputs is from a flip-flop 204. The flip-flop 204 in turn is set by the Start Transmission of Digit (STD) signal 78 from the Readout Control Logic (see FIGS. 1 and 7). Thus while the five cycle per second pulses from the Main Clock are being fed continuously to the AND gate 202, the gate is only enabled by the Start Transmission of Digit signal 78 from the Readout Control Logic. Accordingly, the binary ripple counter starts counting only when a signal is received from the Readout Control Logic on conductor 78.

The output signal from the enabling AND gate 202, in addition to being transmitted to flip-flop 206 of the counter, is also transmitted to the Readout Shift Register 10 in the form of shift pulses on conductor 72. When the flip-flop 204 is turned off by a clearing or stop signal at certain specified times, as will be discussed below, the AND gate 202 is turned off and accordingly the shift pulses to the Readout Shift Register on conductor 72 cease.

Times decoded from the counter in the Readout Shift Register Control 8 are T13, T15, T16, T18, T19, T20, T21, T23, and T25. As with the counters heretofore discussed, the various time signals are the low or the "not" signals from the decoder. These times are significant in that they determine the number of the 5 cycles per second shift pulses which are transmitted to the Readout Shift Register (see FIG. 6). These pulses shift out a particular digit code and they determine the time between digits.

Since T13 is the first time decoded, from when the AND gate 202 is enabled to start the counter 201, 14 shift pulses are transmitted to the Readout Shift Register on conductor 72 until the T13 time is decoded. This is because the counter is started from a full count. Therefore the first clock pulse will set the counter to a count of 0. Zero through 13 comprises 14 counts.

During that period of time, i.e., the period of time from when the counter is started until time T13, the shift pulses are transmitted to the Readout Shift Register 10 to shift out a particular digit code and to establish the time or separation between digits. In other words, 14 shift pulses are the minimum number of pulses required to shift any number or digit, which represents either a minute, a times 10 minutes, or an hour digit, from the Readout Shift Register 10. This happens, for example, in shifting out the hour of "one." Fourteen shift pulses are required to shift out the digit 1 including the proper delay between the hour digit and the times 10 minutes digit. Since each shift pulse occurs every 200 ms, a total of 2.8 seconds is required to shift the 1, a dot, and the time between digits.

The Q and Q(not) outputs from the binary ripple counter 201 are transmitted to a decoder 212 which decodes the desired times, as stated above. The decoded times are in turn transmitted to AND gates 214 through 222, the output of which AND gates are tied together and which clear the flip-flop 204 and set direct the flip-flops 206, 207, 208, 209, and 210 of the binary ripple counter so that each time the AND gate 202 is enabled by the flip-flop 204 and the five cycle per second pulses on conductor 70, the binary ripple counter 201 starts with a full count. Since nine times are decoded from the counter 201, nine AND gates, identified by reference numerals 214 through 222, are required, or one AND gate per time. The other input to each of the AND gates comes from the Zero Through Twelve Decoder 14, as shown in the table at the left top of FIG. 5. The Zero Through Twelve Decoder outputs, which comprise the inputs to the AND gates 214 through 222, are transmitted to a particular AND gate according to the length of time, or the number of shift pulses, required to shift each particular digit. Since there are only nine AND gates, but 13 digits from the Zero Through Twelve Decoder, some of the AND gates are used for more than one digit. These digits occur at times T18, T21, and T23. Accordingly, the AND gates pertaining to those particular times and digits require OR gates into which the digits from the Zero Through Twelve Decoder are transmitted in order to provide only a single digital signal from the Zero Through Twelve Decoder for each AND gate. For example, the digits 7 and 8 comprise the input signals to an OR gate 224, the output of which is transmitted to the AND gate 217 along with the T18 signal from the decoder 212. Thus the OR gate 224 is qualified by either the 7 or the 8 digit signal from the Zero Through Twelve Decoder 14, and when T18 also occurs to enable the AND gate 217, the output therefrom clears the flip-flop 204 to stop the counter 210 by disabling the AND gate 202. At the same time the output from AND gate 217 sets each of the flip-flops in the counter 201 to a full count to prepare the counter for the next counting cycle.

Digits 9 and 11 are inputs to OR gate 226, and digits 0, 10, and 12 are inputs to OR gate 228. The output from OR gate 226 and the T21 signal qualifies AND gate 220. The output from OR gate 228 and the T23 signal qualifies AND gate 221.

When one of the AND gates 214 through 222 is qualified, three events occur. First, the flip-flop 204 is cleared to stop the pulses from AND gate 202, and the counter 201 is prepared for the next counting procedure by setting the flip-flops 206 through 210 to a full count so that the next clock input comprises a count of zero. These two events have been discussed previously. The third event which occurs is that a Shift Next Decimal Digit signal is transmitted to the Readout Control Logic by conductor 80. This indicates to the Readout Control Logic that a decimal digit has been transmitted from the Readout Shift Register by a series of shift pulses on conductor 72 and that the apparatus is now prepared to shift the next decimal digit.

The decoding of the nine different times states actually comprises the number of pulses required for a particular decimal number to be shifted from the Readout Shift Register 10 along with the proper time between digits as illustrated in the code. This is further explained in conjunction with the Readout Shift Register.

READOUT SHIFT REGISTER

Figure 6:
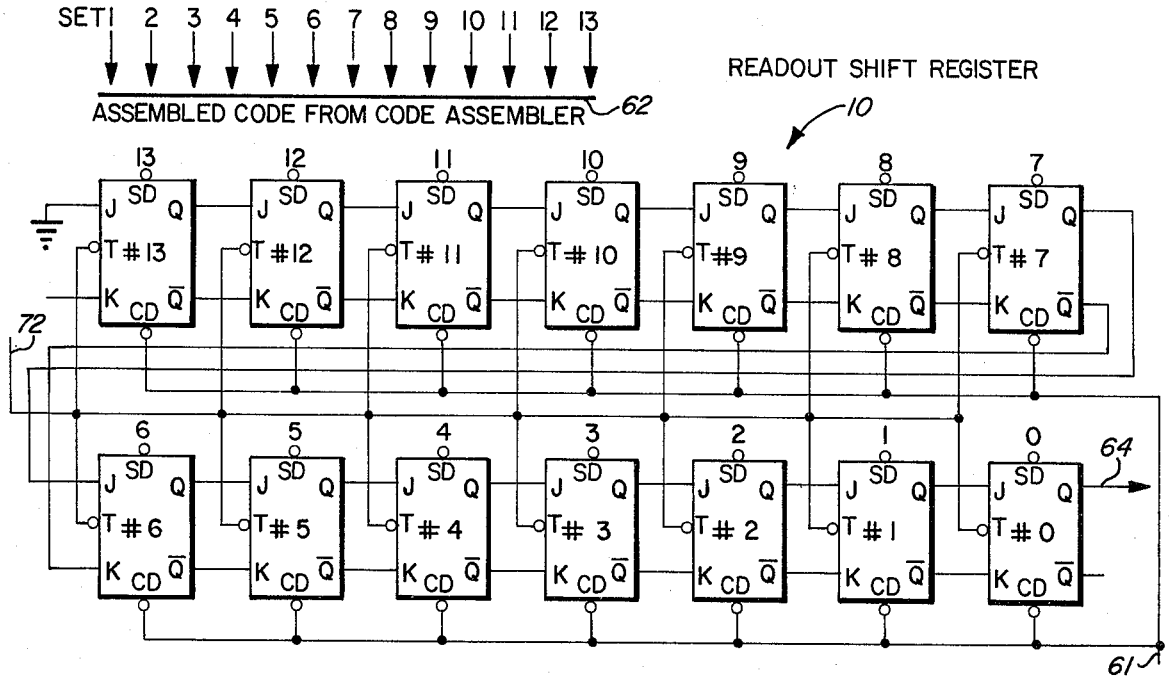
FIG. 6 is a schematic circuit diagram of the Readout Shift Register shown in FIG. 1.

FIG. 6 comprises a schematic representation of the Readout Shift Register 10. The Readout Shift Register 10 includes 14 JK flip-flops, connected as a shift register, and numbered 0 through 13, in reverse order. The set direct terminal of flip-flops 1 through 13, or 13 through 1, as shown, are respectively connected to the set 1 through 13 (or 13 through 1) lines from the Code Assembler 16, (see FIGS. 1 and 9), as indicated at the top left of FIG. 6. The high and low outputs, Q and Q(not), of each flip-flop, beginning with number 13, are respectively connected to the J and K terminals of the adjacent flip-flop in reverse order. The high or Q output of the 0 flip-flop is in turn connected to the Modulator Driver by conductor 64 (see FIG. 1).

Shift pulses from the Readout Shift Register Control 8 (see FIGS. 1 and 5) on conductor 72 are connected to the clock terminal of each flip-flop in parallel such that each shift pulse triggers each flip-flop in order to shift the information contained in one flip-flop to the adjacent flip-flop. The clear direct terminals of all flip-flops are also connected in parallel. The Clear signal comes from the Readout Control Logic 12 on conductor 61 (see FIGS. 1 and 7). Thus a Clear signal from the Readout Control Logic will clear all flip-flops in the Readout Shift Register.

Sequentially, a Clear signal from the Readout Control Logic clears all flip-flops, 0 through 13, prior to the setting of the flip-flops by the assembled code from the Code Assembler and also prior to the receipt of the shift pulses from the Readout Shift Register Control. Inputs from the Code Assembler set the respective flip-flops 1 through 13. Shift pulses from the Readout Shift Register Control go to each flip-flop in the Register 10 as clock inputs. As a result of the shift pulses, the output from the Readout Shift Register is then transmitted serially to the Modulator Driver from the 0 flip-flop on conductor 64.

READOUT CONTROL LOGIC

The Readout Control Logic 12 of the present apparatus is shown in FIG. 7. The figure includes the basic circuitry and logic diagrams for accomplishing the function of the Readout Control Logic, and it also includes a truth table defining the particular times at which specific events occur. The times define or control the various signals and shift pulses originating from the Readout Control Logic. The specific times are defined by signals from 17 AND gate decoders. Each of the AND gates are identified by their respective T outputs or times. The input signals for the AND gates come from five bi-stable flip-flops, which comprise a binary ripple counter 240. The respective outputs from the flip-flops must coincide at particular gates to define the specific times. When the signals do coincide at a particular gate, the output signal which defines a particular time then causes a particular event to occur either in the Readout Control Logic or in other circuits of the apparatus.

The binary ripple counter 240 is a well known state of the art device utilizing five flip-flops, 241, 242, 243, 244, and 245, coupled together. The high or "Q" output of one flip-flop is coupled to the clock input of the next succeeding flip-flop. The counter counts from 0 to 31, with appropriate times being decoded from the various counts by the AND gate decoders. A total of 17 times are thus decoded.

Times are decoded by the 17 AND gate decoders, each of which includes five inputs from the counter's flip-flops. The five inputs to each of the AND gates are taken from the high or Q and low or Q(not) outputs from the flip-flops of the counter. Each output of the 17 AND gates is a low signal when a particular AND gate is qualified to decode a particular time. The times are shown in FIG. 7 and in the truth table therein as comprising low or "not" signals, but for convenience in this specification, the term "not" and/or the bar superposed on the respective times in the truth table and in the schematic portions of the figure will be omitted in the description material herein. Accordingly, and by way of example, the time T1(not) will be referred to only as "Time T1" and/or AND gate "T1" hereafter.

Each flip-flop of the counter 240 comprises a single stage, and the output of each stage represents an arithmetic value which is double that of the previous stage. For example, the output of the first stage, or flip-flop 241, in the high or Q state represents the arithmetic value of 1, and the output of the second stage flip-flop 242 represents an arithmetic value of 2. Accordingly, the high or Q output of the next stages 243, 244, and 245, respectively represent the arithmetic values of 4, 8, and 16. It thus follows that a combination of any or all of the five stages in the high state can give a count anywhere from 0 through 31.

With the outputs from the five stages being coupled to the AND gate decoders, the respective definitions of times which are decoded by the AND gates vary according to the values given for the times. The inverted or low outputs of the AND gates correspond to the times shown in the table in the lower left of FIG. 7.

As is common in the art, and has been discussed, a line above a time or signal represents the low and true value of that time or signal.

The Readout Control Logic includes a flip-flop 250 and an AND gate 252 which must combine signals to begin the counting activities of the counter. The AND gate 252 receives a 10 KHz input signal from the Main Clock on conductor 74. The other input to the AND gate is from the flip-flop 250. The flip-flop 250 receives a Set Direct input from either the Shift Next Decimal Digit, or SNDD(not), signal from the Readout Shift Register Control on conductor 80 or from the on-off switch which is the Readout Begin signal on conductor 30. The Readout Begin signal is a low going grounding signal which is transmitted to both the flip-flop 250 and another AND gate 254. The AND gate 254 also receives the T2 signal to qualify the gate. The output of the AND gate 254 when qualified comprises the Load Time signal to the Present Time Register on conductor 42. This signal allows the Present Time Register 6 (see FIGS. 1 and 4) to receive the time from the Twelve Hour Time Clock 4 (see FIGS. 1 and 3). The time information comprises 12 bits in parallel transmitted into the Present Time Register 6 (see FIG. 4).

A diode 256 blocks the SNDD(not) signal from qualifying the AND gate 254 when there is a beginning signal at the gate. Thus the SNDD(not) signal functions only to set the flip-flop 250. However, the low going Readout Begin signal passes through the diode 256 and also sets the flip-flop 250. When the flip-flop 250 sets, its output qualifies AND gate 252. A 10 KHz signal from the Main Clock on conductor 74 is thus transmitted to, and comprises a clocking signal for, the ripple counter 240.

The flip-flop 250 is reset or cleared at times T5, T17, T29, and T31, and in turn AND gate 252 is disqualified. The clearing of the flip-flop 250 prevents the clock signal from passing through AND gate 252 thus effectively turning the clock signal and the counter 240 off. During the time when the clock signal is off, the control of the time keeping apparatus is vested in the Readout Shift Register Control (see FIG. 5). When the Readout Shift Register Control transmits an SNDD(not) signal to the Readout Control Logic 12, the flip-flop 250 is again set which enables the AND gate 252 when the 10 KHz clock signal next comes through conductor 74. The counter 240 then resumes its counting cycle and the appropriate times are decoded.

Thus at the times T5, T17, T29, and T31, the counter stops to allow other functions to be carried out. At T31, the flip-flop 250 is cleared and the counter stops. By this time the hour, times 10 minutes, and minutes time has been appropriately transmitted and the activities of the time keeping apparatus have thus been completed.

The inputs to the Readout Control Logic comprise the Readout Begin signal on conductor 30 which is actuated by the on-off switch 20. This Begin signal, as has been explained, is a low going grounding signal which enables the AND gate 254 and also sets the flip-flop 250. This in turn results in an output from the AND gate 252 when a coincident 10 KHz pulse is received from the Main Clock on conductor 74 to start the ripple counter 240.

In addition to the Readout Begin signal and the 10 KHz pulses from the Main Clock, the other input signal to the Readout Control Logic is the SNDD(not) signal from the Readout Shift Register Control on conductor 80. This signal sets the flip-flop 250 after it has been cleared by one of the times from the counter, either T5, T17, or T29.

The Readout Control Logic also includes three OR gates 260, 262, and 264. The output of OR gate 260 provides shift pulses to the Present Time Register on conductor 58. These shift pulses result in the shifting of the times 10 minutes and minutes in the Present Time Register and cause the respective times to be made available to the Zero Through Twelve Decoder.

At times T5, T17, and T29, the STD(not) signal is transmitted to the Readout Shift Register Control from the OR gate 262 on conductor 78. Thus at T5, T17, and T29, the Readout Shift Register Control is given the signal to shift pulses to read out the respective hour, times 10 minutes, and minutes. At this time the control of the time apparatus is vested in the Readout Shift Register Control. The Readout Control Logic has temporarily transferred its control.

At time T1, a Clear signal is transmitted from the Readout Control Logic on conductors 60 and 61 to clear the Present Time Register and to clear the Readout Shift Register. This Clear signal clears the registers of the information left in them from the preceding time readout, or from when the time keeping apparatus was last interrogated for a time readout prior to the present readout cycle.

As previously discussed, at time T2 the Readout Begin signal 30 is used coincidentally with T2 to enable the AND gate 254 and the output of the gate is the LT or Load Time signal which is sent to the Present Time Register by conductor 42. This signal causes the Present Time Register to receive 12 bits in parallel from the Twelve Hour Time Clock. Each four bit binary coded decimal input to the Present Time Register comprises respectively the minutes, times 10 minutes, and hours signals.

At times T3, T15, and T27, a signal is transmitted to the Code Assembler from OR gate 264 by conductor 76. This signal, ECA(not) is the Enable Code Assembler signal which enables the Code Assembler and permits it to transmit the respective hour, times 10 minutes, and minutes signal in code to the Readout Shift Register. The ECA(not) signal follows immediately after the time has been loaded into the Zero Through Twelve Decoder from the Present Time Register. Thus T3 follows time T2, at which time the present time is read into the Present Time Register from the Twelve Hour Time Clock, and at the same time the hour time is immediately available to the Zero Through Twelve Decoder. Times T15 and T27 are decoded after the shift pulses respectively of T7, T9, T11, T13, and T19, T21, T23, and T25, which comprise shift pulses for the respective times 10 minutes and minutes information to be transmitted to the Zero Through Twelve Decoder.

Times T15 and T27 thus enable the Code Assembler to encode the respective ten minute and minute digits. Times T15 and T27 are "OR"ed together at OR gate 264 and are transmitted to the Code Assembler by way of conductor 76.

ZERO THROUGH TWELVE DECODER

FIG. 8 schematically illustrates the Zero Through Twelve Decoder 14. The Zero Through Twelve Decoder comprises 13 AND gate decoders, each of which represents a decimal number 0 through 12. Each AND gate decoder includes a series of four inputs, variously connected to the Q and Q(not) outputs from the K′, L′, M′, and N′ flip-flops of the Present Time Register 6 (see FIG. 4).

As shown in FIG. 8, the decimal digit 0 is decoded by the Q(not) outputs from the respective flip-flops in the Present Time Register, while the decimal 1 is decoded by the Q output of K', and the Q(not) outputs of L', M', and N' from the Present Time Register. The other decimal numbers are similarly decoded by the respective outputs of the Present Time Register, as shown in the figure.

As discussed above, each of the four inputs to the AND gate decoders, and thus from the flip-flops in the Present Time Register, is a binary bit representing a value of 1, 2, 4, and 8, respectively. In this manner, by simply adding the various combinations, the decimal values from 0 through 12 can be represented as binary coded decimal inputs to each of the AND gate decoders in the Zero Through Twelve Decoder 14.

The decoded decimal numbers 0 through 12 are transmitted from the Decoder to both the Readout Shift Register and the Code Assembler (see FIGS. 1, 5, and 9) by 13 conductors collectively represented by conductors 54 and 56, respectively on FIG. 1.

Note that the outputs from the AND gate decoders which comprise the Zero Through Twelve Decoder are inverted or low outputs when true. To signify this, there is shown a bar over each decimal number output in FIG. 8 and in FIGS. 5 and 9.

CODE ASSEMBLER

FIG. 9 comprises a schematic diagram of the Code Assembler 16. The Code Assembler is a series of AND gates which use the output signals representing the decoded decimal numbers 0 through 12 from the Zero Through Twelve Decoder 14 (see FIG. 8) as inputs. The outputs of the AND gates in the Code Assembler 16 are transmitted through a diode matrix to the Readout Shift Register 10 (see FIG. 6) as an assembled code representing a decimal number. The assembled code represents a series of dots and dashes, previously discussed, and illustrated in detail in FIG. 10 below. The output from each AND gate of the Zero Through Twelve Decoder is connected to a corresponding input AND gate in the Code Assembler 16. Each input gate of the Code Assembler is also connected to the Readout Control Logic 12 (see FIG. 7) for an enabling signal, Enable Code Assembler, or ECA(not) signal, on conductor 76. The ECA(not) signal enables the respective gates of the Code Assembler, providing there is also an input from the Zero Through Twelve Decoder at a particular gate.

The outputs from the gates of the Code Assembler are connected through diodes to output lines, each of which sets a particular flip-flop of the Readout Shift Register 10, which has been described in detail above in conjunction with FIG. 6. Since the assembled code is a series of dots and dashes, represented by a period of time, with dashes being three times as long as dots, more than one gate of the Code Assembler may be connected through a diode to a particular output or set line. Correspondingly, a set signal for the Readout Shift Register flip-flops may require signals originating from one or several gates in the Code Assembler. This may be illustrated by referring to FIG. 9, in which a signal from only the number 6 gate of the Code Assembler is required to set flip-flops in the Readout Shift Register representing numbers 13 and 12. However, the number 6 gate is also required to set number 11, as is the zero gate, the 10 gate, and the 12 gate. All of the gates, 0 through 12, are required to set the number 1.

The flip-flops of the Readout Shift Register (see FIG. 6) represent the times for either dots or dashes. To illustrate, if the number 1 is represented by a single dot, then the flip-flop representing the number 1 in the Readout Shift Register is set. Since both dots and dashes start with a pulse, it follows that all of the numerals 0 through 12 will require the number 1 flip-flop to be set. But since the number 1 is a single dot, no other flip-flops need to be set to provide the code for the number 1. Arbitrarily, a dash is three times as long as a dot. In other words, three consecutive set flip-flops represent a dash. Since the numbers 4, 5, 6, 8, 10, and 12 begin with dashes in the illustrated code(see Introduction, supra) it is also necessary that flip-flops 2 and 3 be set to represent their beginning dashes. By reading the set lines from left to right and top to bottom as they are connected by diodes to the output of the respective gates, the assembled code in dots and dashes may be read for each of the numbers 0 through 12. For example, 0 in the dot and dash code disclosed herein comprises a dot and dash and two dashes, represented by the set 1 line, the set 4, set 5, set 6 lines, and the set 9, set 10 and set 11 lines, from top to bottom. The number 1 is represented as a single dot on only the set 1 line. The number 4 is a dash, represented by set 1, set 2, and set 3.

Thus the Code Assembler translates or codifies the various decimal outputs from the Zero Through Twelve Decoder into a representation of dots and dashes which in turn represent the various decimal numbers. The dot and dash representatives are transmitted in parallel from the Code Assembler 16 to flip-flops in a Readout Shift Register 10. The code output from the Code Assembler sets the flip-flops according to the desired coding representing the respective decimal numbers.

OUTPUT CODE

Figure 10:
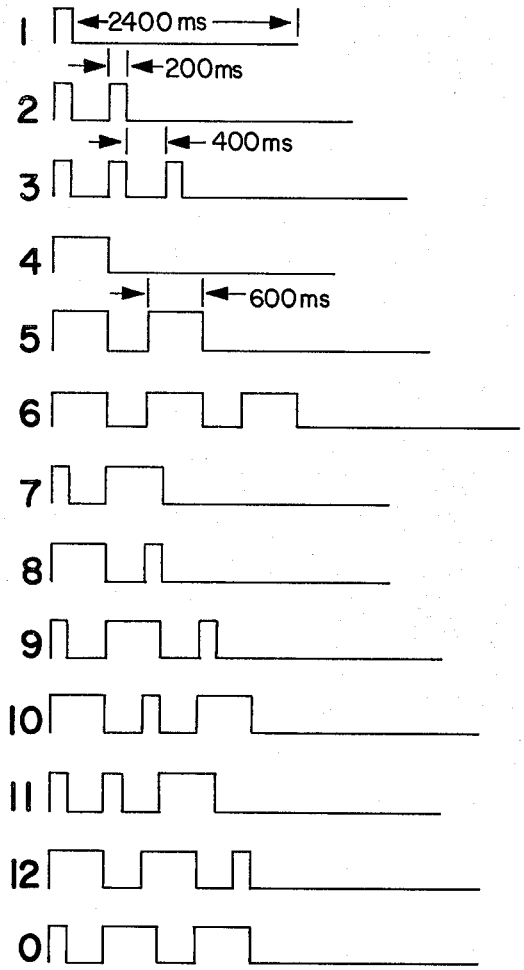
FIG. 10 is a schematic representation of a code usuable in the present invention.

FIG. 10 illustrates the code discussed heretofore and employed in the present invention. The code utilizes dots and dashes to represent the thirteen arithmetic numbers 1 through 12 and 0. The dots and dashes are represented by pulses of different durations, with dashes being three times as long as dots. A dot is represented by a pulse of 200 milliseconds duration, and a dash is represented by a pulse of 600 milliseconds duration.

All 13 numbers are represented by a dot or a dash, or by combinations of not more than three dot and/or dash characters per numeral. Each dot or dash character in a numeral is separated by 400 milliseconds from the next succeeding character. The dot and dash characters of each numeral comprise a character set. Between numerals, there are 2400 milliseconds, or 2.4 seconds.

In FIG. 10 each numeral is shown followed by the 2400 millisecond separation between numerals or character sets. For example, the numeral 1 is represented by a 200 millisecond pulse followed by a 2400 millisecond time period. The numeral 2 is represented by two 200 millisecond pulses separated by a 400 millisecond time period, and the second pulse is followed by a 2400 millisecond time period. The numeral 7 is represented by a 200 millisecond pulse and a 600 millisecond pulse with a 400 millisecond time period between them and the 600 millisecond pulse is followed by a 2400 millisecond time period. Thus the numeral 1 is represented by a dot, or a character set of one character; the numeral 2 is represented by two dots, or a character set of two characters. The numeral 4 is represented by a single character, a dash. The numeral 7 is represented by two characters in its character set, a dot and a dash.

Figure 11:
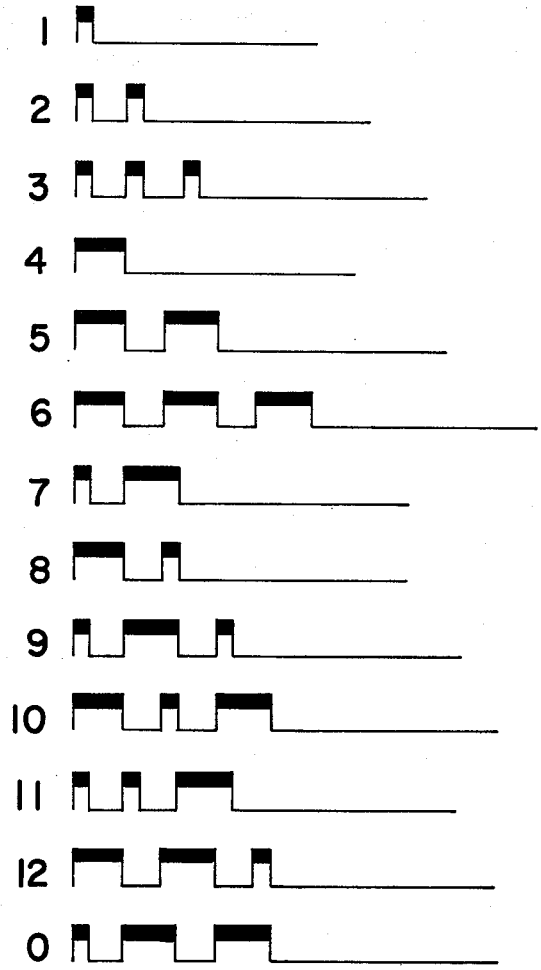
FIG. 11 is a schematic representation of the code of FIG. 10 illustrating the concept of dots and dashes for the code.

FIG. 11 shows substantially the same information as FIG. 10, but with the top portion of each dot and dash character emphasized to more distinctly illustrate the conceptualization of the dots and dashes in a more conventional appearing manner. As shown, the pulses appear as the more traditional concept of dots and dashes.

Figure 12:
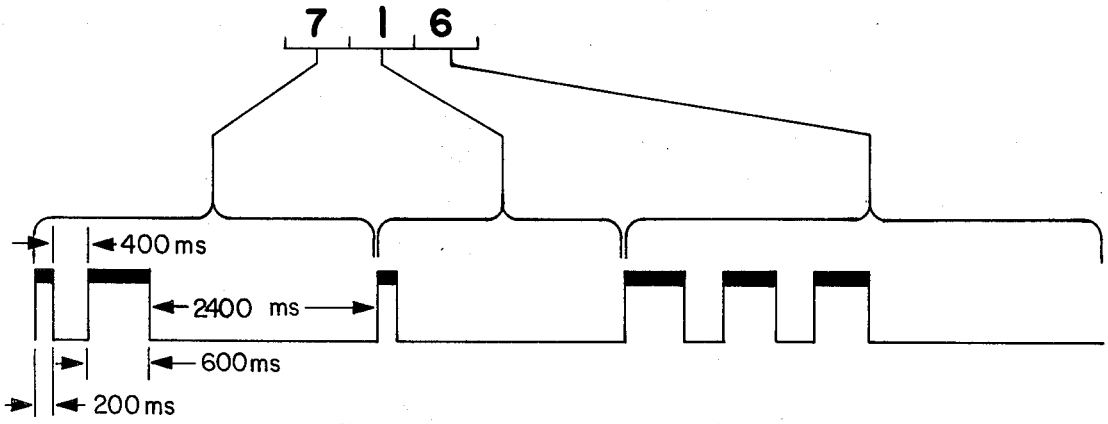
FIG. 12 is a schematic illustration of the number (time) sequence using the codes of FIGS. 10 and 11.

FIG. 12 illustrates the time readout sequence of the numerals 7, 1, and 6, or the time of 7:16. The 7 represents the hour, the 1 represents the times 10 minutes, and the 6 represents the minutes. Each numeral is shown in its coded form of dot and dash characters. The numeral 7 is represented by a dot of 200 milliseconds and a dash of 600 milliseconds, separated by a 400 millisecond time interval. The dot and dash character set is followed by a 2400 millisecond time interval before the next character set is represented, which is a single dot for the numeral 1. The final number is 6, which is represented by three dashes, each of which is a 600 millisecond pulse separated by 400 millisecond time intervals. Each character set is separated from the next succeeding character set by a 2400 millisecond time interval, or 2.4 seconds.

The pulses in FIG. 12 are illustrated with the dot and dash emphasis similar to those of FIG. 11. The time shown is 7:16, or 16 minutes after the hour of 7. The 16 minutes, with respect to the apparatus disclosed herein, comprises one 10 minute time period after the hour plus a 6 minute time period.

MODULATOR DRIVER

Figure 13:
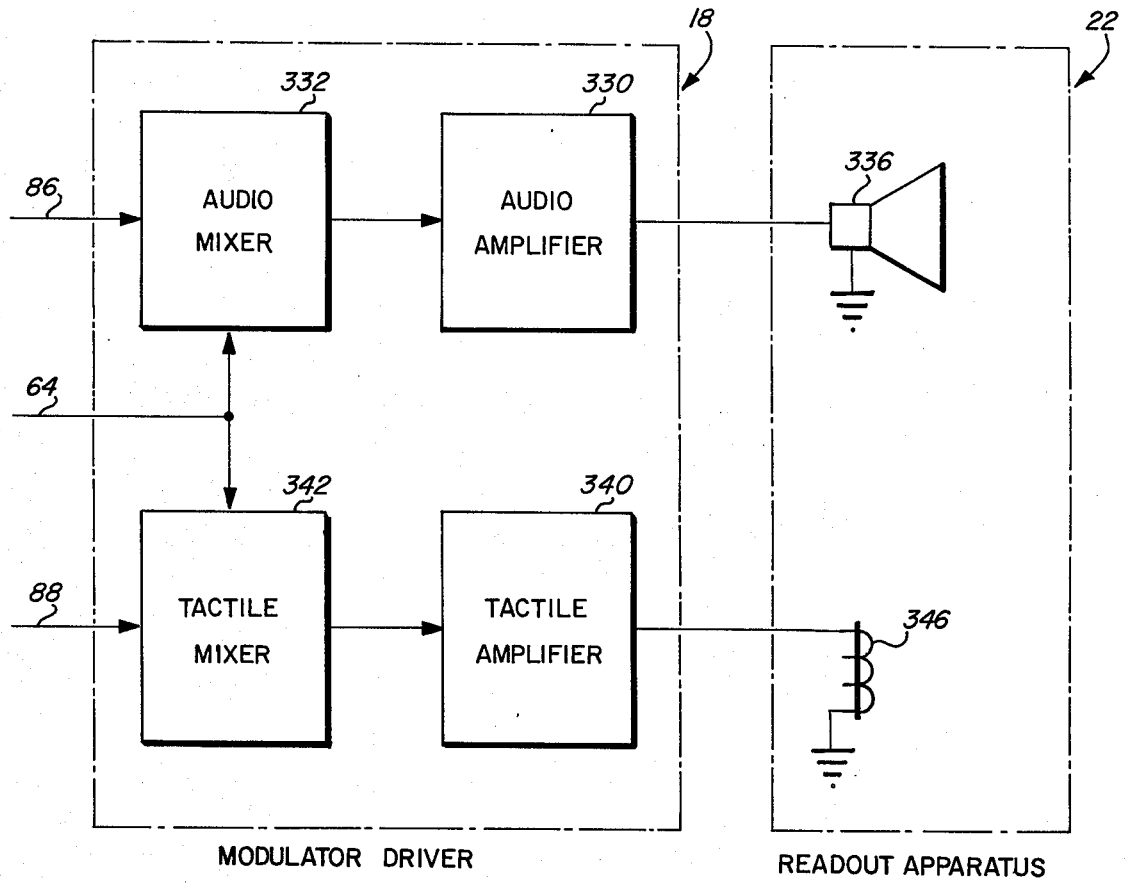
FIG. 13 is a schematic circuit and block diagram of the modulator and readout apparatus of the present invention.

The Modulator Driver 18 shown as a block in FIG. 1 is illustrated in more detail in FIG. 13. The Modulator Driver preferably includes a pair of amplifiers, an audio output amplifier 330 and a tactile output amplifier 340. Each amplifier is connected to a mixer which receives a signal from the Main Clock and also a signal comprising modulating pulses from the Readout Shift Register 10. See FIG. 1 and FIG. 6.

Conductor 86 transmits a 1000 Hz signal from the Main Clock to an audio mixer 332, and conductor 88 transmits a 100 Hz signal from the Main Clock to a tactile mixer 342. The mixers also receive modulating pulses from the Readout Shift Register on conductor 64. The pulses from the Readout Shift Register are mixed with and modulate the respective signals from the Main Clock in the respective mixers. The mixer units comprise well known apparatus for modulating a continuous signal to accomplish pulse modulation.

From the mixer, either audio mixer 332 or tactile mixer 342, the modulated pulses are transmitted to the respective amplifier where the pulse trains are amplified to proper power levels. The 1000 Hz pulse trains from the audio amplifier 330 are transmitted to a speaker 336 in Readout Apparatus 22. The 100 Hz pulse trains from the tactile amplifier 340 are transmitted to tactile readout apparatus 346 in Readout Apparatus 22.

Thus the series of dots and dashes representing the coded time from the Readout Shift Register are modulated either by a 1000 Hz signal for an audio output or by a 100 Hz signal for a tactile output. From the Modulator Driver the respective coded time is transmitted to the Readout Apparatus, which may be either (or both) a speaker for the audio output or appropriate tactile apparatus for a tactile output.

If a tactile output is desired, the Readout apparatus could include a solenoid or some type of vibrating apparatus which may be sensed by the user of the time keeping apparatus as a series of dots and dashes using the 100 Hz signal as the basis for the coded dots and dashes.

OPERATION

FIG. 1 may be referred to again for the operational description of the apparatus.

The following signals are continuously occurring during normal operation of the time keeping apparatus and originate from the Main Clock 2:

1. A 5 Hz clock pulse is transmitted to the Readout Shift Register Control 8 on conductor 70.
2. A 10 KHz clock pulse is transmitted to the Readout Control Logic 12 on conductor 74.
3. A 10 KHz Enable Loading Signal is transmitted to the Present Time Register 6 on conductor 44.
4. A 1 cycle per minute clock signal on conductor 3 continuously increments the Twelve Hour Time Clock 4. The clock 4 counts the minutes and arranges them into three individual decimal characters representing the present hour, the particular 10 minute interval or period after the hour, and minutes after a particular 10 minute period. For example, the time 3:45 represents the hour of 3, plus four 10 minute periods after 3, plus 5 minutes after the fourth 10 minute period.
5. A 1 KHz continuous signal is transmitted to the Modulator Driver 18 on conductor 86 for an audio readout, if such is employed. A 100 Hz continuous signal is transmitted to the Modulator Driver 18 on conductor 88 for a tactile readout, if such is employed.

The Twelve Hour Time Clock 4 continuously stores time information in the binary coded decimal form of three discrete digits representing the present minutes, the particular 10 minute interval or period after the hour, and the present hour, and such time digits are respectively represented by signals 36, 38, and 40 in FIG. 1.

The following sequence of events occurs when a person (user) requests the time to be read out:

Switch 20 is actuated, resulting in a Beginning Signal 30 to the Readout Control Logic 12.

The Readout Control Logic 12 sends a Clear signal to the Present Time Register 6 and to the Readout Shift Register 10 over conductors 60 and 61, respectively. It is necessary to clear the registers of information from a previous time readout cycle.

The Readout Control Logic 12 sends a Load Time signal over conductor 42 to the Present Time Register. Forty microseconds later the Main Clock 2 sends an Enable Loading signal over conductor 44 to the Present Time Register. Signals on conductors 42 and 44 are combined to enable the Present Time Register to accept the present time, comprising signals 36, 38, and 40, from the Twelve Hour Time Clock 4. The above described sequence is designed to prevent the Present Time Register from being loaded during a possible time when the Twelve Hour Time Clock 4 is incrementing or changing its time count.

When the present time is stored in the Present Time Register, the apparatus is ready to start transmitting the present time out of the apparatus to the Modulator Driver 18. When the present time, 36, 38, and 40, is loaded into the Present Time Register 6, the present hour is then immediately made available from the Register 6 to the Zero Through Twelve Decoder 14 in binary coded decimal form by way of conductors 46, 48, 50, and 52.

The Zero Through Twelve Decoder 14 receives the present hour in binary coded decimal form from conductors 46, 48, 50, and 52, and decodes it from the binary coded decimal form into a single low level voltage signal to be transmitted to the Code Assembler 16 by conductor 54 and to the Readout Shift Register Control 8 by conductor 56. As previously discussed, the conductors 54 and 56 actually each comprise 13 discrete conductors (see FIG. 8). Which of the 13 conductors the signal is actually present on will depend on the value of the hour digit, whether it is a 1, 4, 9, 11, etc.

Next in the sequence of events the Readout Control Logic 12 sends an Enable Code Assembler signal over conductor 76 to the Code Assembler 16. This results in the present hour signal present on one of the 13 conductors 54 being transformed into a special dot and dash code (see FIG. 10) by the Code Assembler. The dot and dash code representing the present hour is transmitted in the form of 13 individual high and low level voltages on the 13 conductors represented by reference numeral 62 in FIG. 1. These 13 high and low voltages representing the present hour in dot and dash form either set or not set 13 flip-flops in the Readout Shift Register 10 so as to store in the Register the dot and dash code representing the present hour.

The Readout Control Logic 12 sends a Start Transmission of Digit signal over conductor 78 to the Readout Shift Register Control 8. By this signal the Readout Control Logic transfers control of the apparatus to the Readout Shift Register Control. The Readout Shift Register Control 8 sends 5 Hz shift pulses over conductor 72 to the Readout Shift Register 10. This results in the Readout Shift Register shifting out serially the dot and dash code representing the present hour. The dot and dash code is shifted over conductor 64 to the Modulator Driver 18 where it is modulated with a continuous 1 KHz signal present on conductor 86 for audio readout application of the apparatus or modulated with a 100 Hz continuous signal present on conductor 88 for tactile readout application of the apparatus.

The Readout Shift Register Control performs two functions. One function is to shift out the dot and dash code, representing the present hour, from the Readout Shift Register 10 to the Modulator Driver 18. The second function is to provide or schedule the time delay between the hour digit and the 10 minute digit as depicted in FIG. 12. The Readout Shift Register Control 8 accomplishes its first function by knowing the time length of the dot and dash code of the particular hour value being transmitted. This is accomplished by the introduction of the hour value being transmitted to the Readout Shift Register Control over conductor 56 from the Zero Through Twelve Decoder. The signal present on one of the 13 conductors 56 indicates or tells the Readout Shift Register Control the required time necessary to shift out the particular dot and dash code representing the present hour. The Readout Shift Register Control then combines the information from the Zero Through Twelve Decoder with a standard time representing the time between the hour and the 10 minute digits to determine the total time for shifting out the hour digit and the time between the hour digit and 10 minute digit. After the Readout Shift Register Control has determined that the proper time has lapsed, it gives control back to the Readout Control Logic 12 by sending a Shift Next Decimal Digit signal over conductor 80 to the Readout Control Logic.

The Readout Control Logic 12 then transmits four shift pulses over conductor 58 to the Present Time Register 6. This results in the 10 minute digit, in binary coded decimal form, being shifted four places to the "four" hour flip-flops in the Present Time Register. At the same time the minute digit is shifted four places to the four 10 minute flip-flops. The 10 minute digit in binary coded decimal form is now available to the Zero Through Twelve Decoder 14 over conductors 46, 48, 50, and 52. In other words, the same conductors and techniques are used to encode and shift out the 10 minute digit as was used for the hour digit. The Zero Through Twelve Decoder 14 decodes the 10 minute digit from its binary coded decimal form and changes it to a single low level voltage existing on one of the 13 conductors 54 and 56 according to the numerical value of the digit. Subsequently the Readout Control Logic 12 sends an Enable Code Assembler signal over conductor 76 to the Code Assembler 16. This results in the Code Assembler changing the ten minute digit from the single low level voltage on one of the conductors 54 to a series of high and low level voltages which represents the 10 minute digit in a dot and dash code form. The action of the Enable Code Assembler signal on conductor 76 also results in the 10 minute digit being transmitted into the Readout Shift Register 10 in dot and dash code form by the 13 conductors 62.

The above described sequence of events is repeated. The Readout Control Logic 12 sends a Start Transmission of Digit signal to the Readout Shift Register Control 8 over conductor 78. This in effect transfers control of the apparatus from the Readout Control Logic to the Readout Shift Register Control, which immediately starts transmitting shift pulses to the Readout Shift Register 10 over conductor 72. This results in the ten minute digit being shifted out of the Readout Shift Register in dot and dash form over conductor 64 to the Modulator Driver 18 which modulates the dot and dash code with either the 100 Hz or the 1 KHz signals for either the tactile or the audio readout of the apparatus.

After the 10 minute digit has been shifted out, the Readout Shift Register Control 8 continues to calculate or determine time, as discussed above, so as to allow for the time between the 10 minute digit and the minute digit. Once this time has been determined, the Readout Shift Register control sends a Shift Next Decimal Digit signal to the Readout Control Logic 12 over conductor 80. This in effect transfers control of the apparatus back to the Readout Control Logic 12 from the Readout Shift Register Control.

The Readout Control Logic 12 then transmits four shift pulses to the Present Time Register 6 over conductor 58. This results in the minute digit, which exists in binary coded decimal form in the four 10 minute flip-flops of the Present Time Register, shifting four places to the four hour flip-flops. The minute digit is now available to the Zero Through Twelve Decoder 14 by way of conductors 46, 48, 50, and 52 in binary coded decimal form from the four flip-flops in the Present Time Register. The minute digit is then transmitted to the Code Assembler and the Readout Shift Register Control, and to the Readout Shift Register and the Modulator Driver by the same conductors and using the same procedure or technique as described above for the 10 minute digit. When the Readout Shift Register Control 8 transfers control back to the Readout Control Logic 12 over conductor 80, the readout action of the apparatus, which was initiated by switch 20, comes to a stop.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operating requirements, without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for serially reading out time comprising, in combination:

clock means for providing clock pulses;

counter means for counting pulses from the clock means and for providing output pulses in terms of minutes, 10 minutes, and hours, register means connected to the counter means for storing and shifting pulses representing time information in terms of minutes, 10 minutes, and hours;

encoding means connected to the register means for serially encoding the pulses representing time information into pulses of varying time lengths;

control means for controlling the storing, shifting, and encoding of pulses; and output means for providing a serial output of the encoded time information.

2. The apparatus of claim 1 in which the register means includes a present time register for storing and shifting time information from the counter means to the encoding means.

3. The apparatus of claim 2 in which the register means further includes a readout shift register for storing and serially shifting encoded time information from the encoding means to the output means.

4. The apparatus of claim 3 in which the control means includes means for controlling the serial storing and shifting of pulses in the present time register in response to clock pulses from the clock means.

5. The apparatus of claim 4 in which the control means further includes means for controlling the encoding of time information from the present time register in response to clock pulses from the clock means.

6. The apparatus of claim 5 in which the control means further includes means for controlling the serial shifting of encoded time information from the readout shift register to the output means in response to clock pulses from the clock means.

7. The apparatus of claim 6 in which the output means includes modulator means for modulating the encoded time information from the readout shift register in response to clock pulses from the clock means.

8. The apparatus of claim 7 in which the output means further includes amplifier means for amplifying the modulated encoded time information.

9. The apparatus of claim 8 in which the output means further includes readout apparatus for serially reading out the encoded time information.

10. The apparatus of claim 9 in which the clock means includes an oscillator and a plurality of counters for providing a plurality of clock pulse frequencies.

* * * * *